United States Patent [19]

Hardman

[11] 4,191,297

[45] Mar. 4, 1980

[54] SUPPORT AND COVER RESTRAINING DEVICE FOR REFUSE CONTAINERS

[76] Inventor: Olin A. Hardman, 5947 S. 600 W., Murray, Utah 84107

[21] Appl. No.: 945,235

[22] Filed: Sep. 25, 1978

[51] Int. Cl.[2] ..... A47G 29/00

[52] U.S. Cl. ..... 211/83; 248/147; 248/154; 248/DIG. 7

[58] Field of Search ..... 211/71, 76, 82, 83, 211/84; 248/84, 134, 146, 147, 154, DIG. 7

[56] References Cited

U.S. PATENT DOCUMENTS

| | | | |
|---|---|---|---|
| 2,160,433 | 5/1939 | Griffin et al. | 248/146 |
| 2,534,680 | 12/1950 | Poirer | 211/76 |
| 2,690,893 | 10/1954 | Mokhiber | 248/DIG. 7 X |
| 2,865,590 | 12/1958 | Greenwell | 248/DIG. 7 X |
| 2,905,333 | 9/1959 | Lownsbery | 248/DIG. 7 X |
| 3,007,664 | 11/1961 | Fairbanks et al. | 248/DIG. 7 X |
| 3,208,706 | 9/1965 | Clark | 248/147 |
| 3,219,195 | 11/1965 | Mize | 211/71 |
| 3,255,986 | 6/1966 | Eadie | 248/DIG. 7 |
| 3,288,306 | 11/1966 | Walters | 248/DIG. 7 X |
| 3,388,856 | 6/1968 | Safford | 211/83 X |
| 3,561,606 | 2/1971 | Stewart | 211/84 |

*Primary Examiner*—Thomas J. Holko

*Attorney, Agent, or Firm*—Thorpe, North & Gold

[57] ABSTRACT

A support and cover restraining device for holding refuse containers including a post with mounting brackets for attaching a plurality of refuse containers and a guide rod projecting from the top of the post for mounting support arm structure having container covers attached at opposing ends thereof. The support arm structure includes first and second support arms attached to form a bowed structure. Central openings in the respective support arms permit placement on the guide rod and provide a separation distance between the respective openings to maintain the arms in a pivotal, radial orientation with respect to the post axis. A coil spring is positioned around the guide rod and between the respective support arms to impose a downward biasing force to maintain the lids in a closed position.

9 Claims, 1 Drawing Figure

SUPPORT AND COVER RESTRAINING DEVICE FOR REFUSE CONTAINERS

BACKGROUND OF THE INVENTION

1. Field of the Invention

This invention relates to support devices for refuse cans. More particularly, the invention is directed to the field of restraining devices for covers or lids to refuse containers supported on a standard or post.

2. Description of the Prior Art

The support of refuse containers with associated covers or lids has been discussed in previous patents with respect to supporting structure for the container, as well as means for retaining a lid or cover in a closed configuration to prevent rumaging by small animals. U.S. Pat. Nos. 3,288,306 and 3,675,783 illustrate bracket structure attached to a post which gives stability and support for retaining a plurality of trash cans conveniently at a common situs. Such support structure provides the benefit of raised elevation for the convenience of the user and prevention from rust and water damage associated with snow and ground water.

The aforementioned support structure, however, does not provide adequate means for retaining the lids or covers in a closed position. Without adequate restraining means, the refuse containers may be subject to rummaging by dogs, cats or other curious animals. In addition, winds may be of sufficient strength to lift loose covers from the refuse containers, thereby exposing the contents to the elements and rummaging animals. In an attempt to solve this problem, U.S. Pat. Nos. 2,865,590 and 2,985,416 have incorporated spring biased arms which attach at a lid and are retained in a closed position until lifted by means of the arm.

Although the structure disclosed in these respective patents does apply tension to the lid cover, this single arm arrangement does not prevent children, and in some cases animals, from lifting the lid to the refuse container. This can be done by lifting at the handle or center of the lid in each instance, or by urging the edge of the lid upward. In both cases, the protective function of the arm structure is obviated.

OBJECTS AND SUMMARY OF THE INVENTION

It is therefore an object of the present invention to provide container support and cover restraining means to a plurality of refuse containers which prevent undesirable access to container contents.

It is a further object of this invention to provide structure which requires raising of all attached container covers concurrently in order to obtain access to any single container.

It is still further object of this invention to provide a support and cover restraining device which is both asthetically pleasing and functionally operable to maintain a plurality of container covers in a self-locking, closed position.

These and other objects are realized in a support and cover restraining device for holding refuse containers which includes a post having upright orientation and mounting fixtures at a top section for attachment of a plurality of refuse containers. The post is also adapted with stabilizing brackets projecting from a base section of the post for retaining the refuse containers in a substantial upright orientation. A guide rod projects from the top section of the post along its longitudinal axis, and serves to support a first support arm through a central opening therein which has means for attaching covers at the respective ends thereof. A second support arm is also mounted through a central opening at the rod and is attached at the first support arm in bowed relationship thereto, the openings of the respective arms being aligned and positioned on the rod with a separation distance therebetween to maintain the arms in a pivotal, radial orientation with respect to the post axis. A spring tension means is coupled to the arms and operates to bias them to a low position along the post axis corresponding to a closed position for the covers with respect to the containers. The container covers are removed from the closed position by lifting upward at the central portion of the support arms and rotating the support arm structure about the rod to expose the container opening.

Other objects and features will be obvious to a person skilled in the art from the following detailed description, taken with the accompanying drawings, in which FIG. 1 shows a perspective view of the subject invention.

DETAILED DESCRIPTION OF THE INVENTION

Figure 1:
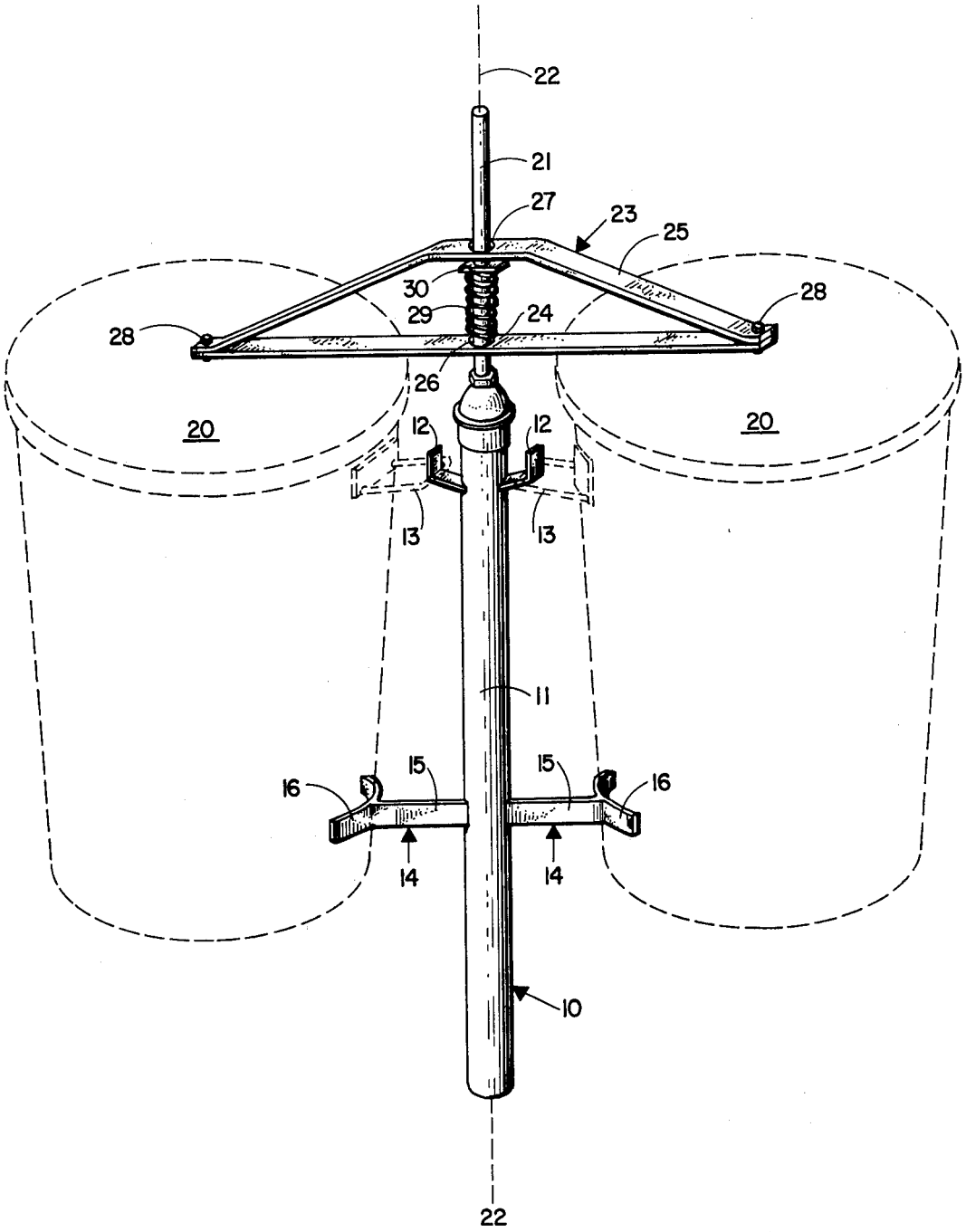

Referring to the drawings:

A support and cover restraining device is shown generally 10 with phantom lines representing the attachment of two refuse containers. The device consists of a post or comparable form of standard which is adapted in construction for upright orientation. The post may be positioned in the ground, a cement base or a platform, depending upon the degree of stability and mobility desired by the user.

Mounting means 12 are fixed near the top section of the post to enable attachment of the refuse containers thereto. It is preferrable that the mounting means 12 permit removal of the trash containers. In the depicted embodiment, refuse container handles 13 are retained at the mounting means 12 which comprise a pair of brackets, each bracket having an upward lip for holding the handle in place. It will be obvious to one skilled in the art that numerous forms of mounting means may be provided to removably attach the containers at the post 11.

In addition to the mounting means, stabilizing means 14 are provided to retain the containers in upright orientation. This is accomplished in the depicted embodiment by use of projecting arms 15 which are mounted at the central portion of the convex sides of arcuate braces 16. As will noted from the drawings, the curved surfaces of the refuse containers fit into the concave sections of the arcuate bracket 16, thereby stabilizing the containers in an upright orientation.

The combination of post 11, mounting means 12 and stabilizing means 14 provide the structure to hold the refuse containers in fixed position. The height of the containers above ground level will obviously depend upon the location of the mounting and stabilizing means, as well as the length and method of emplacement for the post. As will be explained in greater detail hereafter, the height of the containers provides some control with respect to access to the container openings. A child, for example, may be able to reach the container lids 20 but will be unable to lift the lids unless the upper structure of the device can be reached.

This access control is accomplished in part by the use of a guide rod 21 which extends above the post 11, projecting along the longitudinal post axis 22. This rod 21 can be adjustably mounted within the post 11 by bolt locking means 23 or it may be fixed to the post in perminant attachment.

The guide rod 21 serves as a guide means and support for the attachment of the support arm structure 23 to which the container covers are attached. The function of the support arm structure 23 is to provide a rigid coupling means between the respective covers of a plurality of refuse containers. This rigid coupling means must be fixed in radial orientation at approximately 90° to the post axis and should be coordinated with the relative placement of the containers about the post in manner such that the containers are separated by the maximum possible distance. In the attached figure, this separation is a 180° as shown. The function of the support arm structure 23 is to require concurrent lifting of each of the container covers 20 in order to expose any of the container openings.

This function is accomplished by a combination of first and second support arms 24 and 25 which are attached at the ends thereof to form a single support arm structure 23. The first support arm 24 has a central opening 26 which is aligned with a central opening 27 in the second support arm 25 Means for attachment 28 are included at opposing ends of the support arm structure to permit fixation of the covers 20 thereto.

The second support arm 25 is of bowed configuration with respect to the first support arm 24. This structure provides a space or separation distance between the respective support arms which operates to stabilize the support arm structure in the desired radial orientation with respect to the post axis 22. This structure results in a self-locking mechanism which requires the tandum lifting of the container covers. If, for example, only one cover is lifted, the second support arm 25 will engage the guide rod 21 at the side from which the lifting force is applied. Because of the small opening 27 through the support arm 25, upward movement of the cover is blocked. This provides an effectual self-locking mechanism which inhibits undesirable removal of the container covers.

Proper removal of the container covers is accomplished by applying a lifting force to the support arm structure 23 substantially along the post axis 22. The support arm structure is thereby moved upward along the post axis, lifting both lids concurrently. When the container covers are above the container bodies, the support arm structure is rotated to expose the container opening. It will be apparent that the separated support arms, having aligned central openings, provide the desired structure to enable the pivotal, radial orientation of the support arm structure and attached container covers.

The container covers may be spring biased to a closed position by the use of a spring tension means 29 which provides a force opposing the upward lifting force previously discussed. As shown in the drawings, a coil spring is a suitable spring tension means 29 and may be positioned on the guide rod between the first and second support arms 24 and 25. Movement of the spring is blocked in the upward direction by a stop 30 which is fixed to the guide rod 21. In this configuration the support arms are biased to a low position along the post axis corresponding to a closed position for the covers with respect to the containers. This biasing arises from the slight tension imposed with the compression of the coil spring 29. Upon application of a lifting force along the post axis 22 the support arm structure is raised, further compressing the coil spring 29. The support arm structure and attached lids are thereby raised to a higher position, sufficient to allow rotation of the arms and attached covers about the post axis.

It will be apparent to those skilled in the art that modifications to this structure may be incorporated without departing from the inventive concepts disclosed herein. For example, although the figure illustrates a first and second support arm structure comprising straight and trapizoidal members respectively, other configurations can be developed which maintain the desired separation distance between the openings of the first and second support arm members. For example, the second support arm may comprise an arcuate member as opposed to the trapezoidal member illustrated. Additionally, the point of attachment of the second support arm to the first support arm may vary along the length of the first support arm, provided the appropriate separation distance is preserved between the openings of the first and second support arms.

With respect to the preferred separation distance mentioned, the actual distance will be determined based on ease of access desired. It is apparent that the greater the distance separating the respective arms, the greater the rigidity which will maintain the respective covers in a radial orientation with respect to the post. Practical limitations would suggest, however, that sufficient rigidity is realized in a separation distance of approximately 4–5 inches, based on the use of a standard size refuse container.

In addition to the various geometric configurations for the support arm structure, variations can also arise in form and placement of the spring tension means. For example, the coil spring may be coupled to the support arm structure 23 and fixed at one end to the post 11. Furthermore, variations may arise in the form of spring tension means applied. Numerous types of spring or elastic devices may be utilized, such as rubber strands or the like. Therefore, it is to be understood that the present disclosure is by way of example and that these variations, along with others, are possible without departing from the scope of the hereinafter claimed subject matter, which subject matter is to be regarded as the invention.

I claim:

1. A support and cover restraining device for holding refuse containers, comprising:

a. a post adapted for upright orientation and having mounting means fixed near a top section thereof for attachment of a plurality of refuse containers;

b. stabilizing means projecting from said post for retaining said refuse containers in substantial upright orientation;

c. a guide rod projecting from the top section of said post along a longitudinal axis thereof;

d. a first support arm having a central opening and means at opposing ends of said arm for attachment of covers for said refuse containers;

e. a second support arm having a central opening therein and having bowed structure in relation to said first arm, said second arm being attached at ends thereof to said first arm in orientation such that said central openings are aligned, said arms being positioned on said rod through the aligned openings and having a separation distance therebetween to maintain said arms in a pivotal, radial orientation with respect to said post axis; and f. spring tension means coupled to and biasing said arms to a low position along said post axis corresponding to a closed position for said covers with respect to said containers, said tension means being responsive to a lifting force applied to said arms along said axis to permit upward movement of said arms to a higher position to allow rotation of said arms with attached container covers, thereby exposing openings of said containers.

2. A support and cover restraining device as defined in claim 1, wherein said mounting means comprise brackets disposed on opposite sides of said post for receiving handle attachments of two separate refuse containers.

3. A support and cover restraining device as defined in claim 1, wherein said stabilizing means comprise a pair of arcuate braces projected from and attached to said post near a base section thereof by radially extending arms which attach centrally at convex sides of said arcuate braces.

4. A support and cover restraining device as defined in claim 1, wherein said first and second support arms comprise straight and trapezoidal members respectively, the latter being attached at ends thereof to a top surface of the former.

5. A support and cover restraining device as defined in claim 1, wherein said first and second support arms comprise straight and arcuate members respectively, the latter being attached at ends thereof to a top surface of the former.

6. A support and cover restraining device as defined in claim 1, wherein the separation distance between the openings of the first and second support arms is approximately 4 to 5 inches.

7. A support and cover restraining device as defined in claim 1, wherein the spring tension means comprises a coil spring positioned around the guide rod and between said openings, said spring being in fixed position at an upper end with respect to said rod, said arms being slidably disposed through said openings about said rod.

8. A support and cover restraining device as defined in claim 1, wherein the spring tension means comprises a coil spring positioned around said rod and coupled at one end to said first support arm, the other end being fixed in position with respect to said post.

9. A support and cover restraining device as defined in claim 1, further comprising locking means coupling said rod to said post in adjustable relationship, thereby permiting adjustments of said rod to variable heights with respect to said post.

* * * * *